US006799511B2

(12) United States Patent
McLean et al.

(10) Patent No.: US 6,799,511 B2
(45) Date of Patent: Oct. 5, 2004

(54) GAPLESS COMPRESSIBLE CYLINDER ASSEMBLY

(75) Inventors: Michael E. McLean, Etowah, NC (US); Arthur H. Rogrove, Arden, NC (US); Phillip K. Loyer, Waynesville, NC (US)

(73) Assignee: Day International, Inc., Arden, NC (US)

( * ) Notice: Subject to any disclaimer, the term of this patent is extended or adjusted under 35 U.S.C. 154(b) by 0 days.

(21) Appl. No.: 10/308,408

(22) Filed: Dec. 3, 2002

(65) Prior Publication Data

US 2004/0103804 A1 Jun. 3, 2004

(51) Int. Cl.[7] ..... B41F 13/10
(52) U.S. Cl. ..... 101/375; 492/49
(58) Field of Search ..... 101/375, 374, 101/376, 368, 216, 217, 483, 486, 401.1; 492/49, 56

(56) References Cited

U.S. PATENT DOCUMENTS

| | | | | |
|---|---|---|---|---|
| 3,035,331 A | | 5/1962 | Wieman | |
| 3,978,254 A | | 8/1976 | Hoexter et al. | |
| 4,119,032 A | | 10/1978 | Hollis | |
| 4,144,813 A | | 3/1979 | Julian | |
| 4,378,622 A | | 4/1983 | Pinkston et al. | |
| 4,537,129 A | | 8/1985 | Heinemann et al. | |
| 4,812,219 A | | 3/1989 | Sattrup et al. | |
| 4,903,597 A | * | 2/1990 | Hoage | 101/375 |
| 4,949,445 A | | 8/1990 | Van Der Meulen et al. | |
| 5,072,504 A | * | 12/1991 | Thompson | 29/426.6 |
| 5,168,808 A | | 12/1992 | Prem | |
| 5,289,769 A | | 3/1994 | Lewis | |
| 5,351,615 A | | 10/1994 | Kobler et al. | |
| RE34,970 E | | 6/1995 | Tittgemeyer | |
| 5,440,981 A | | 8/1995 | Vrotacoe et al. | |
| 5,507,226 A | | 4/1996 | Burke et al. | |
| 5,507,228 A | | 4/1996 | Schultz | |
| 5,535,674 A | | 7/1996 | Vrotacoe et al. | |
| 5,544,584 A | | 8/1996 | Thompson et al. | |
| 5,553,541 A | | 9/1996 | Vrotacoe et al. | |
| 5,654,100 A | | 8/1997 | Kobler et al. | |
| 5,740,738 A | | 4/1998 | Niemiro | |
| 5,752,444 A | * | 5/1998 | Lorig | 101/375 |
| 5,768,990 A | | 6/1998 | Vrotacoe et al. | |
| 5,778,779 A | | 7/1998 | Jones et al. | |
| 5,782,181 A | * | 7/1998 | Rossini | 101/375 |
| 5,813,334 A | | 9/1998 | Blanchard | |
| 5,813,336 A | | 9/1998 | Guaraldi et al. | |
| 5,816,154 A | | 10/1998 | Stuart | |
| 5,819,657 A | * | 10/1998 | Rossini | 101/376 |
| 5,832,824 A | | 11/1998 | Okubo et al. | |
| 5,983,799 A | | 11/1999 | Lane, III et al. | |

(List continued on next page.)

FOREIGN PATENT DOCUMENTS

| | | |
|---|---|---|
| DE | 355 111 C | 6/1922 |
| DE | 90 07 391 U | 6/1991 |
| EP | 0 732 201 A | 9/1996 |
| FR | 1 327 229 A | 5/1963 |
| GB | 2 051 681 A | 1/1981 |
| WO | WO 97/29897 | 8/1997 |

*Primary Examiner*—Eugene H. Eickholt
(74) *Attorney, Agent, or Firm*—Dinsmore & Shohl LLP

(57) ABSTRACT

A gapless printing system includes a cylinder assembly and a printing sleeve. The cylinder assembly includes a compressible layer located between an inner shell and an outer shell. A support carrier is coupled to the inner shell about each of the first and second end portions and is adapted such that the cylinder assembly is mountable in a printing press. A printing sleeve is removably attachable to the cylinder assembly by installing the printing sleeve over the outer shell such that when the printing sleeve is mounted on the cylinder assembly, lateral and rotational motion of the printing sleeve with respect to the cylinder assembly is prevented.

43 Claims, 4 Drawing Sheets

U.S. PATENT DOCUMENTS 6,148,725 A 11/2000 Knauer et al.
6,276,271 B1 8/2001 Busshoff
6,347,582 B1 2/2002 Jones
6,360,662 B1 3/2002 Busshoff
6,386,100 B1 * 5/2002 Gaffney et al. ..... 101/217
6,389,965 B1 * 5/2002 Vrotacoe et al. ..... 101/217
6,409,645 B1 * 6/2002 Paasonen et al. ..... 492/56
6,513,431 B2 * 2/2003 Huber ..... 101/375
6,523,470 B2 * 2/2003 Kolbe et al. ..... 101/375
6,669,613 B1 * 12/2003 Van Denend ..... 492/49
2002/0002921 A1 * 1/2002 Hoffmann ..... 101/376
2002/0023562 A1 2/2002 Busshoff
2002/0038609 A1 * 4/2002 Rossini et al. ..... 101/101.1
2002/0046668 A1 * 4/2002 Bell et al. ..... 101/376
2002/0073859 A1 * 6/2002 Vrotacoe et al. ..... 101/217
2003/0047097 A1 * 3/2003 Dzierzynskl et al. ..... 101/368

* cited by examiner

GAPLESS COMPRESSIBLE CYLINDER ASSEMBLY

BACKGROUND OF THE INVENTION

The present invention relates in general to a printing cylinder and in particular to a gapless print cylinder assembly having an integral compressible layer.

A typical cylinder on an offset printing press includes an axially extending groove, or lock up gutter with clamping segments. Printing blankets are provided in sheets that are wrapped around the cylinder such that the opposite ends of the printing blanket are inserted and clamped in the groove. Because the loose ends of the blanket must be secured to the cylinder, the surface of the blanket when mounted will have a gap where the edges are drawn. As a consequence, print quality, speed of operation and available print region dimensions are affected. Also, press downtime due to printing blanket change over time can be excessive.

Press downtime associated with printing blanket change over can sometimes be minimized where the printing blanket is provided as a gapless printing sleeve that is capable of mounting onto the cylinder. The printing sleeve typically includes several layers including a base sleeve, a compressible layer, and a printing face. During use, the printing sleeve is stretched over the cylinder and is thus exposed to considerable peripheral and circumferential forces. Additionally, while operating the press, the printing sleeve is exposed to high revolution speeds and the printing face of the sleeve is exposed to impact with other components of the press, including printing plates of a plate cylinder. As such, the printing sleeve will eventually dynamically fatigue. Where the printing sleeve has experienced sufficient dynamic fatigue, print quality will be affected, requiring replacement. However, it is usually either the printing surface, or the adhesive that holds the printing surface to the internal layers, that will fail. The remaining layers are often functionally and structurally intact.

Currently, some fatigued printing sleeves are discarded. This leads to considerable waste and cost as the materials used to construct the base layer and internal layers, including the compressible layer, constitute a significant portion of the total materials cost for the sleeve production. Alternatively, the fatigued printing sleeves may be sent back to the manufacturer to be reconditioned or "recapped". While reconditioning allows for recycling of certain reusable portions of the fatigued printing sleeve, the press operator must ship the entire printing sleeve back to the manufacturer. The manufacturer must remove the worn portions of the printing sleeve, and assemble a new printing surface and internal components to the printing sleeve. This causes considerable cost to the manufacturer. Further, in the course of shipping a printing sleeve, it is possible to damage the otherwise in tact layers causing increased cost and delay.

SUMMARY OF THE INVENTION

The present invention overcomes the disadvantages of previous printing sleeves and cylinders by providing a gapless cylinder assembly having an integral compressible layer. The cylinder assembly is arranged to receive replaceable printing surfaces.

According to one embodiment of the present invention, a gapless print cylinder assembly includes an inner shell having a first end portion, a second end portion, and a body portion. A support carrier is coupled to the inner shell about each of the first and second end portions. The support carrier is adapted to support the gapless print cylinder assembly when mounted on a press. For example, the support carrier may include first and second plugs that define spaced end journal and bearing members. An outer shell is positioned over and generally coaxial with the inner shell, and a compressible layer is located between the inner shell and the outer shell. A printing sleeve is attached, but removable from the outer shell of the cylinder assembly such that when the printing sleeve is mounted on the cylinder assembly, lateral and rotational motion of the printing sleeve with respect to the cylinder assembly is prevented.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that mechanical changes may be made without departing from the spirit and scope of the present invention. Reference is made to the figures, which illustrate printing cylinder construction according to the present invention. It will be appreciated that these are diagrammatic figures, and that the dimensions are not shown to scale.

Figure 1:
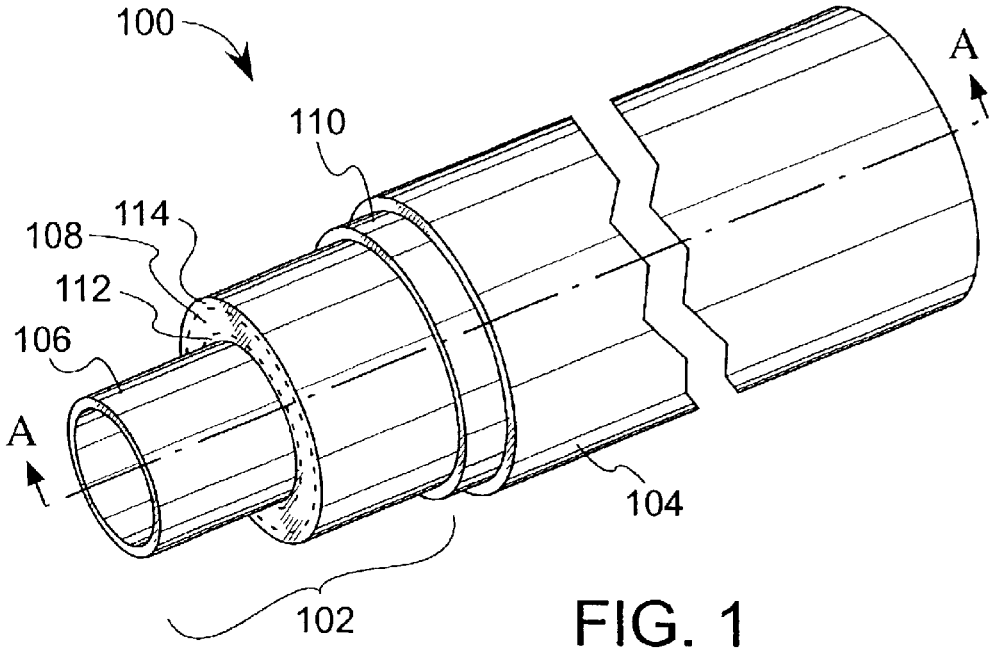
FIG. 1 is a diagrammatic view of a gapless print cylinder assembly and printing surface according to one embodiment of the present invention, where the cylinder assembly and the printing sleeve are shown with layers that are cut away for illustrative purposes.

As shown in FIG. 1, a gapless printing system 100 includes a print cylinder assembly 102 and a printing sleeve 104. The print cylinder assembly 102 comprises an inner shell 106, a compressible layer 108, and an outer shell 110. Each of the components of the gapless printing system 100 are illustrated in cut out fashion progressively cut away from the left hand side of FIG. 1 so that each individual component may be identified and discussed.

The inner shell 106 according to one embodiment of the present invention comprises a generally hollow tube or shell. The inner shell 106 may take on any number of diameters, lengths and shell thickness depending upon the intended application. However, the inner shell 106 is typically sized such that the overall diameter of the print cylinder assembly 102 and associated printing sleeve 104 correspond generally with the dimensions of an original cylinder and printing sleeve for which the present invention is intended to replace. For example, the inner shell 106 is typically between 2 inches (5.08 centimeters) to 10 inches (25.4 centimeters) in diameter and 12 inches (30.48 centimeters) to 100 inches (254 centimeters) in axial length.

The inner shell 106 may be molded or otherwise formed such as by rolling a flat sheet of material into the desired shell shape, which is typically generally cylindrical and may optionally have a slight taper along the axial length thereof. Also, the inner shell 106 can be constructed from any number of materials including for example, a highly flexible metal foil, a steel shell such as carbon steel typical of offset press cylinders, fiberglass reinforced plastic, fiberglass reinforced polyester resin, electroformed nickel or a composite material.

The inner shell 106 may also be constructed from carbon fiber reinforced polymer resins, such as a carbon fiber reinforced epoxy. Carbon fiber is believed to be a good material for the inner shell because carbon fiber can be engineered to exhibit a desired flexibility and strength. Carbon fiber also provides the necessary heat resistance to withstand rubber vulcanization temperatures. Further, carbon fiber is lightweight, strong, and cost effective to manufacture. Other fibers such as glass fibers, aramid fibers, metal fibers, ceramic fibers or any other synthetic endless or long fibers that increases the stability, stiffness, and rigidity of inner shell 106 may also be used.

Polymer resins such as phenolic resins and aromatic amine-cured epoxy resins may also be used in the fabrication of the inner shell 106. Preferred polymer resins are those that are capable of withstanding rubber vulcanization temperatures of up to about 160 degrees Celsius without softening or degrading. In construction, the fibrous material is provided as a fiber strand that is wound onto a support. Alternatively, the fibrous material may comprise a woven fabric. The fibrous material and polymer resin may be applied to the support in a variety of ways. For example, polymer resin may be coated onto the support and the fibrous material wound or wrapped about the polymer resin. Alternatively, the fibrous strand or woven fabric may be impregnated with polymer resin and applied to the support. The application of fibrous material and resin may be repeated to build up a sufficient wall thickness for the inner shell 106. Once the inner shell 106 reaches a predetermined thickness, the outer surface of the inner shell 106 is worked, such as by mechanically grinding, to achieve desired tolerances. Alternatively, the inner shell 106 may be fabricated by a pultrusion process in which the support comprises a forming die.

The compressible layer 108 is a permanent or semi-permanent layer and can comprise any arrangement adapted to absorb deflections of the outer shell 110 during operations. For example, the compressible layer 108 can comprise an elastomeric layer, a polymer or other material that provides suitable compressibility characteristics, a compressible fluid or gas such as compressed air, or combination thereof.

According to an embodiment of the present invention, the compressible layer 108 comprises an elastomeric-based layer having the required properties to perform applications typically associated with heat set web offset printing. The compressible layer 108 is preferably resistant to solvents and ink and may be provided on the inner shell 106 using any suitable technique. For example, the compressible layer 108 may be applied over the inner shell 106 using conventional spreading machines. Alternatively, the compressible layer 108 may be formed directly onto the inner shell 106 using pour or injection molding techniques. The compressible layer 108 may alternatively be applied to the inner shell 106 as laminated layers of compressible material, or using extrude, spray or spun processes. Further, the compressible layer 108 may be substantially vulcanized or secured to the inner shell 106 by means of a suitable adhesive. Also, the compressible layer 108 may require additional processing and preparation. For example, it may be necessary to grind the compressible layer 108 to a desired dimension, typically between 0.010 inches (0.0254 centimeters) and 0.500 inches (1.27 centimeters), before completing assembly of the gapless printing system 100.

As an example, an elastomeric compound including known processing, stabilizing, strengthening and curing additives may be used to form the compressible layer 108. Any suitable polymeric material that is considered a curable or vulcanizable material can be used, including for example, natural rubber, styrene-butadiene rubber (SBR), ethylene/propylene/nonconjugated dieneterpolymer rubber (EPDM), butyl rubber, neoprene, butadiene, acrylonitrile rubber (NBR), millable urethane or polyurethanes. Extruded tubes and two-part rotary castings may also be used to form the compressible layer 108. Voids are formed in the compressible layer 108 using for example, microspheres, salt leach processes, or foam inserted using a blowing agent. For example, the compressible layer 108 may be formed by uniformly mixing hollow microspheres with an uncured rubber and solvent and applying the mixture over the inner shell 106. Further details of the composition of the compressible layer may be found in U.S. Pat. No. 4,770,928 entitled, "METHOD OF CURING A COMPRESSIBLE PRINTING BLANKET AND A COMPRESSIBLE PRINTING BLANKET PRODUCED THEREBY", the disclosure of which is herein incorporated by reference.

Adhesive may be applied to the surface of inner shell 106 or to one or both surfaces of the inner shell 106 and the compressible layer 108 to secure the compressible layer 108 to the inner shell 106. Adhesive may be in the form of a thin film or tape having a thickness of between about 0.05 mm to about 1.5 mm, and may be either pressure sensitive or be activated by heat. Alternatively, the compressible layer 108 may include a rubber/microsphere mixture that is spread onto the inner shell 106 using a knife or blade to provide a uniform thickness. Alternatively, the compressible layer 108 may comprise polyurethane precursors (such as polyols and isocyanates) and be applied as a liquid while the underlying inner shell 106 is rotating. In this embodiment, there is no need for a mold, although a molding or shaping step may optionally be utilized. The shape and dimensions of the compressible layer 108 may be controlled by controlling the selection of the reactants, temperatures, and degree of crosslinking and by applying appropriate volumetric amounts of the materials to the underlying inner shell 106. The compressible layer 108 may then be cured or partially cured in place. Where a rotary casting method is utilized, there is no need for the use of additional adhesives to secure the compressible layer 108 to the inner shell 106. Still further, where the compressible layer 108 is provided as an extruded tube, the compressible layer 108 may be radially expanded and slid into place on the inner shell 106.

Depending upon a number of factors including for example, the manner in which the compressible layer 108 is implemented, the print cylinder assembly 102 may also include one or more intermediate layers. A first and second intermediate layer 112, 114 are shown in FIG. 1. The intermediate layers are shown in FIG. 1 with dashed lines indicating that both the first and second intermediate layers 112, 114 are optional. The first intermediate layer 112 is shown positioned between the compressible layer 108 and the inner shell 106. The second intermediate layer 114 is shown between the compressible layer 108 and the outer shell 110.

The first and second intermediate layers 112, 114 may comprise a polymer wound cord, fabric, wound fibers such as polyester, cotton, fiberglass, cotton-wrapped polyester, rayon, carbon filaments, thin metal plating or layers, or other high modulus synthetic or organic fibers. Suitable synthetic fibers include for example, aramid fibers and fiberglass or polyester threads. The first and second reinforcing layers 112, 114 are not required to practice the present invention. However, such intermediate layers may provide additional rigidity to the underlying components thus reducing the chance of damaging the inner shell 106 during handling. The first and second intermediate layers 112, 114 may also be used to impart a high coefficient of friction between adjacent layers.

According to another embodiment of the present invention, the compressible layer 108 is provided by securing the outer shell 110 over the inner shell 106 to define a hollow chamber therebetween. A fluid source such as hydraulic or air under pressure is selectively provided to the chamber defined between the inner and outer shells 106, 110. Under this arrangement, the print cylinder assembly 102 should also preferably include a pressure release valve and other necessary fluid passageways, and may optionally require a bladder or other such device to contain the fluid source.

The outer shell 110 comprises a generally smooth, thin shell. The outer shell 110 preferably has a wall thickness sufficiently thin so as to allow the outer shell 110 to deflect when operating in the nip of offset transfer points in an offset printing operation. The outer shell 110 also typically has an axial length corresponding to the axial length of the inner shell 106. According to an embodiment of the present invention, the outer shell 110 comprises a thin carbon fiber shell. The outer shell 110 may also comprise other materials including those materials described with reference to the inner shell 106. Additionally, the outer shell 110 may be formed from any layer of non-stretchable material, a layer of woven or nonwoven fabric, or a durable layer such as a reinforcing film or coating including for example, mylar (polyester), a reinforced film such as aramid fiber, cord, fiberglass or a surface layer of hard polyurethane. Where the outer shell 110 is formed from a fabric layer, the material may include woven fabric from high-grade cotton yarns, which are free from slubs and knots, weaving defects, seeds, etc. The fabric may also be rayon, nylon, polyester or mixtures thereof, and may also include other appropriate fiber compositions.

The printing sleeve 104 may be any printing surface suitable for the intended printing application. For example, the printing sleeve 104 may comprise a sheet formed around and adhesively held to a reinforcing layer. Alternatively, the printing sleeve 104 may comprise a gapless tubular composite such as an extruded face tube. The printing sleeve 104 is removably attachable to the surface of the outer shell 110 such that when the printing sleeve 104 is mounted on the outer shell 110 of the print cylinder assembly 102, lateral and rotational motion of the printing sleeve 104 with respect to the cylinder assembly 102 is prevented. As such, the print cylinder assembly 102 and the printing sleeve 104 will rotate as an integral unit when properly installed on a suitable press.

Figure 2:
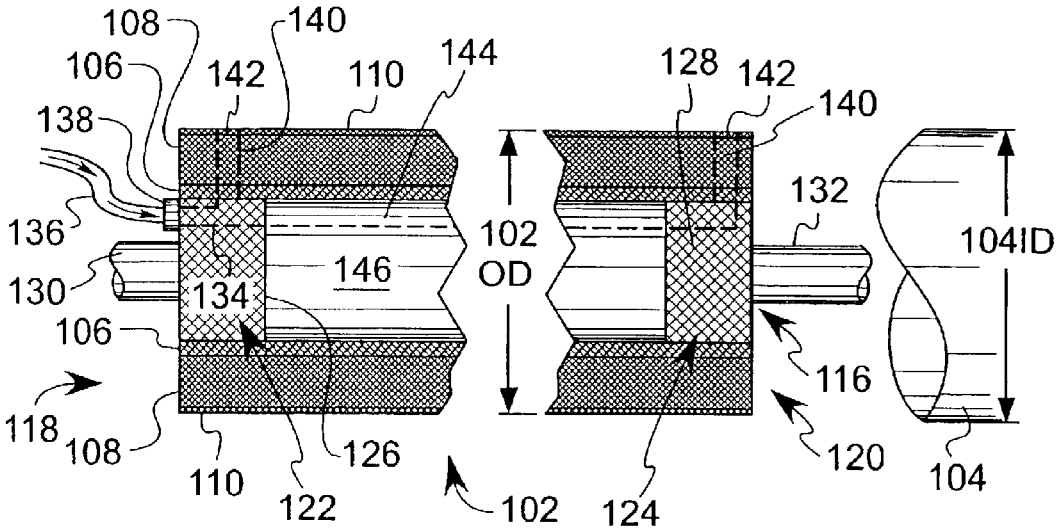
FIG. 2 is a cross-sectional view of the gapless print cylinder assembly and printing surface of FIG. 1 taken along line A—A according to an embodiment of the present invention.

Referring to FIG. 2, a support carrier 116 is coupled to the inner shell 106 about each of the first and second end portions 118, 120 respectively, of the cylinder assembly 102. The support carrier 116 is adapted to support the gapless printing system 100 when mounted in a press. As shown, the support carrier 116 includes first and second plugs 122, 124 that define spaced end journal members. Each of the first and second plugs 122, 124 includes a generally cylindrical support 126, 128 dimensioned to fit securely within the inside diameter of the inner shell 106. Each of the first and second plugs 122, 124 also includes an outward projecting shaft 130, 132. The shafts 130, 132 are arranged coaxially and are used to rotatably mount the cylinder assembly on the printing press. Although shown as two separate shafts 130, 132, a single shaft may alternatively be used.

According to one embodiment of the present invention, while both the print cylinder assembly 102 and the printing sleeve 104 are in relaxed states, the print cylinder assembly 102 has an outer diameter 102OD that is greater than the inner diameter 104ID of the printing sleeve 104. The printing sleeve 104 is expanded radially outward by applying a pressurized source, such as compressed air, between 60–150 PSI and typically 80 PSI, against the inner surface of the printing sleeve 104. The printing sleeve 104 is then floated over the print cylinder assembly 102. The printing sleeve 104 need only be radially expanded a sufficient amount, for example, 0.001 inches (0.00254 centimeters) to 0.050 inches (0.127 centimeters), typically 0.005 inches (0.0127 centimeters) to 0.020 inches (0.0508 centimeters), to allow the printing sleeve 104 to slip onto the print cylinder assembly 102. When the pressurized source is relieved, the printing sleeve 104 contracts around the outer shell 110 and is frictionally secured thereto such that the print cylinder assembly 102 and the printing sleeve 104 rotate as an integral unit.

To expand the printing sleeve 104, one or both of the first and second plugs 122, 124 include at least one fluid passageway 134. The fluid passageway 134 is selectively coupled to a fluid source 136 via an expansion and contraction valve 138. When the fluid source 136 is energized and the expansion/contraction valve 138 is open, the fluid source 136 is projected generally radially from the print cylinder assembly 102 to provide creep to the printing sleeve 104 to install the printing sleeve 104 onto the print cylinder assembly 102. The fluid passageway 134 includes aeration channels 140 that open to apertures 142. The location of the aeration channels 140, and accordingly the location of the apertures 142, may be varied depending upon the application. Any number of apertures 142 may be provided. Further, the apertures 142 may be provided in any configuration. For example, referring to FIG. 3, the apertures 142 are illustrated on the left hand side of the print cylinder assembly 102 arranged in a circumferential pattern positioned near the end portion of the print cylinder assembly 102. The apertures 142 may also be arranged generally axially along the length of the print cylinder assembly 102 as shown on the right hand side of the print cylinder assembly 102. The generally axial positioning of the apertures 142 may be in addition to, or as an alternative to the circumferential pattern of apertures 142.

Referring back to FIG. 2, to channel the pressurized source to the apertures 142, the fluid passageway 134 may include a central lumen 144. Under this arrangement, the aeration channels 140 extend radially outward from the central lumen 144 coupling the apertures 142 to the fluid passageway 134. The hollow portion 146 of the inner shell 106 may be used as the central lumen 144, or alternatively, the inner shell 106 may require ductwork or other passages to couple the expansion/contraction valve 138 to each of the plurality of apertures 142. The fluid passageway 134 can alternatively pass through one or more of the intermediate layers including for example, the compressible layer 108.

According to one embodiment of the present invention, a fluid source 136, such as compressed air provided by an air assist tool, is used to selectively apply the pressurized source to the print cylinder assembly 102. The source is directed radially out through the apertures 142 with sufficient force to diametrically expand the inner diameter of the printing sleeve 104 sufficient to allow the printing sleeve 104 to slide over the outer shell 110 of the print cylinder assembly 102. For example, the internal surface of the printing sleeve 104 is elastically expandable diametrically in a slight amount. As the printing sleeve 104 is slid towards the print cylinder assembly 102, the pressure forced through the aeration channels 140 and associated apertures 142 causes expansion of the inside diameter of the printing sleeve 104 radially outward, thus providing creep allowing the printing sleeve 104 to slip on and off the outer shell 110 of the print cylinder assembly 102.

Once the print sleeve 104 is properly situated on the outer shell 110, the fluid source is removed. As such, the inside diameter of the printing sleeve 104 contracts generally causing a tight frictional relationship to exist between the print cylinder assembly 102 and the printing sleeve 104. Accordingly, the print cylinder assembly 102 and the printing sleeve 104 will operate as an integral unit when properly installed on a suitable press. Preferably, the printing sleeve 104 is expandable under moderate air pressure, for example, 100 PSI or less.

When changing over the printing sleeve 104, the print cylinder assembly 102 may remain attached to a press. As an alternative to leaving the print cylinder assembly 102 on the press, the entire gapless printing system 100 may be removed from the press prior to replacing the printing sleeve 104. Under this arrangement, the printing sleeve 104 is preferably replaced on-site, such as near the printing press. For example, the print cylinder assembly 102 may be attached to a mounting frame (not shown), a new printing sleeve 104 is placed on the print cylinder assembly 102, and then the gapless printing system 100 is replaced on the press.

According to an embodiment of the present invention, the compressible layer 108 may be implemented using a fluid source. For example, referring to FIG. 4, a chamber 150 is provided between the inner and outer shells 106, 110. The compressible layer 108 is defined by a fluid source, such as pneumatic or hydraulic, applied to the chamber 150 so as to provide the desired compressibility characteristics. Depending upon a number of factors including for example, the composition of the inner and outer shells 106, 110, an optional inflatable member 152 such a bellows chamber or bladder may be provided between the inner and outer shells 106, 110. Under this arrangement, the outer shell 110 provides a relatively thin and durable skin over the inflatable member.

One or more fluid supply lines 154, 156 are communicably coupled to the inflatable member 152 to selectively charge and bleed the fluid in the inflatable member 152. The number and configuration of the supply lines 154, 156 will vary depending upon the type of fluid source used. For example, as shown, the inflatable member 152 is coupled to a charge line 158 and a bleed line 160 such as a high-pressure release valve. The charge and bleed lines 158, 160 are further coupled to appropriate control device(s) (not shown). The control device may be located within the inner cylinder 106, or external to the print cylinder assembly 102. Where the control device is located outside the print cylinder assembly 102, a leadthrough 162 through the plug 122 and necessary ductwork 164 may be necessary.

Where an inflatable member 152 is used as the compressible layer 108, the printing sleeve 104 may be attached to the outer shell 110 by relieving the pressure in the inflatable member 152, such as by activating the bleed line 160 to evacuate at least a portion of the fluid source stored in the chamber 140 to allow a slight contraction of the print cylinder assembly 102. When the chamber 140 is sufficiently deflated, the printing sleeve 104 may be slid over the outer shell 110. The inflatable member 152 is then recharged, such as by activating the charge line 148 to re-supply the fluid source to the chamber 140 thus expanding the outer shell 110 against the printing sleeve 104. Alternatively, the cylinder assembly 102 may include the necessary duct work and aeration holes required to float a printing sleeve 104 over the outer shell 110 in a manner analogous to that described with reference to FIGS. 2 and 3.

Figure 3:
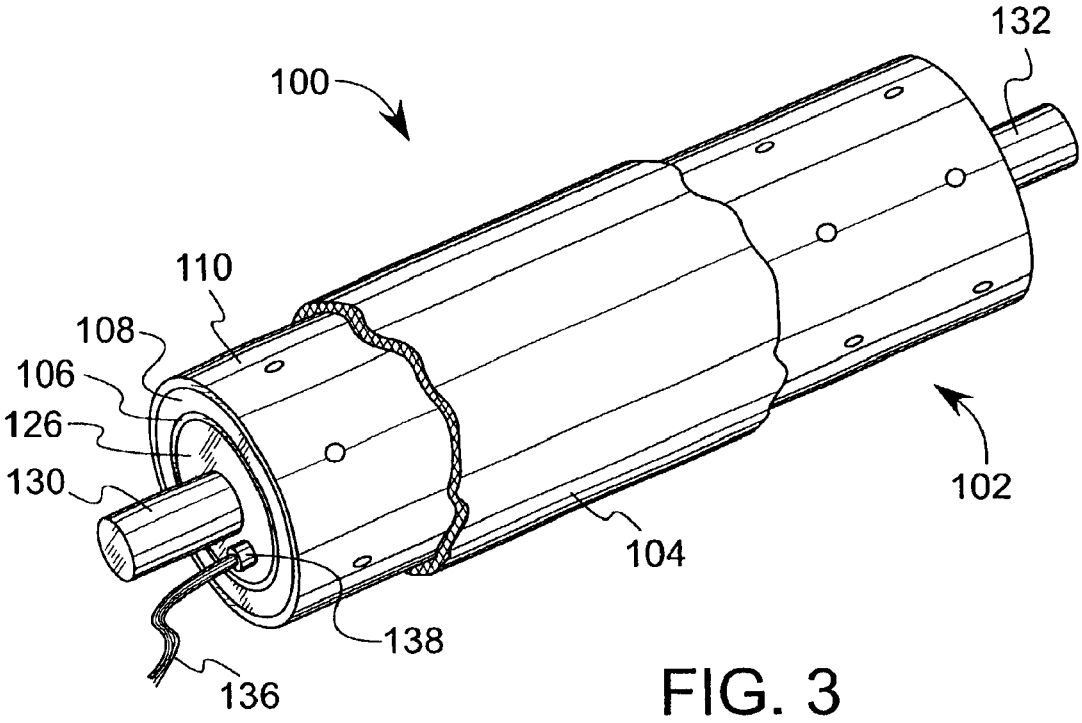
FIG. 3 is a diagrammatic view of a gapless print cylinder assembly system according to one embodiment of the present invention, where the cylinder assembly includes apertures for installing and removing printing sleeves.
Figure 5:
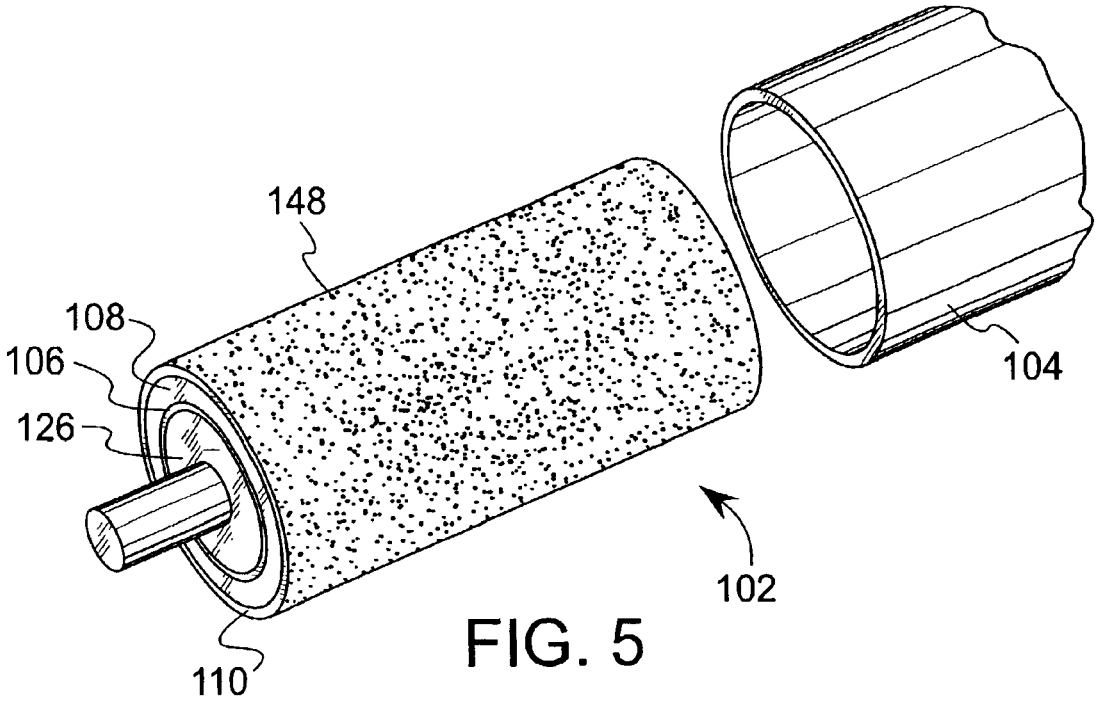
FIG. 5 is a diagrammatic view of the gapless print cylinder assembly system according to one embodiment of the present invention, where the printing sleeve is removably secured to the cylinder assembly.
Figure 4:
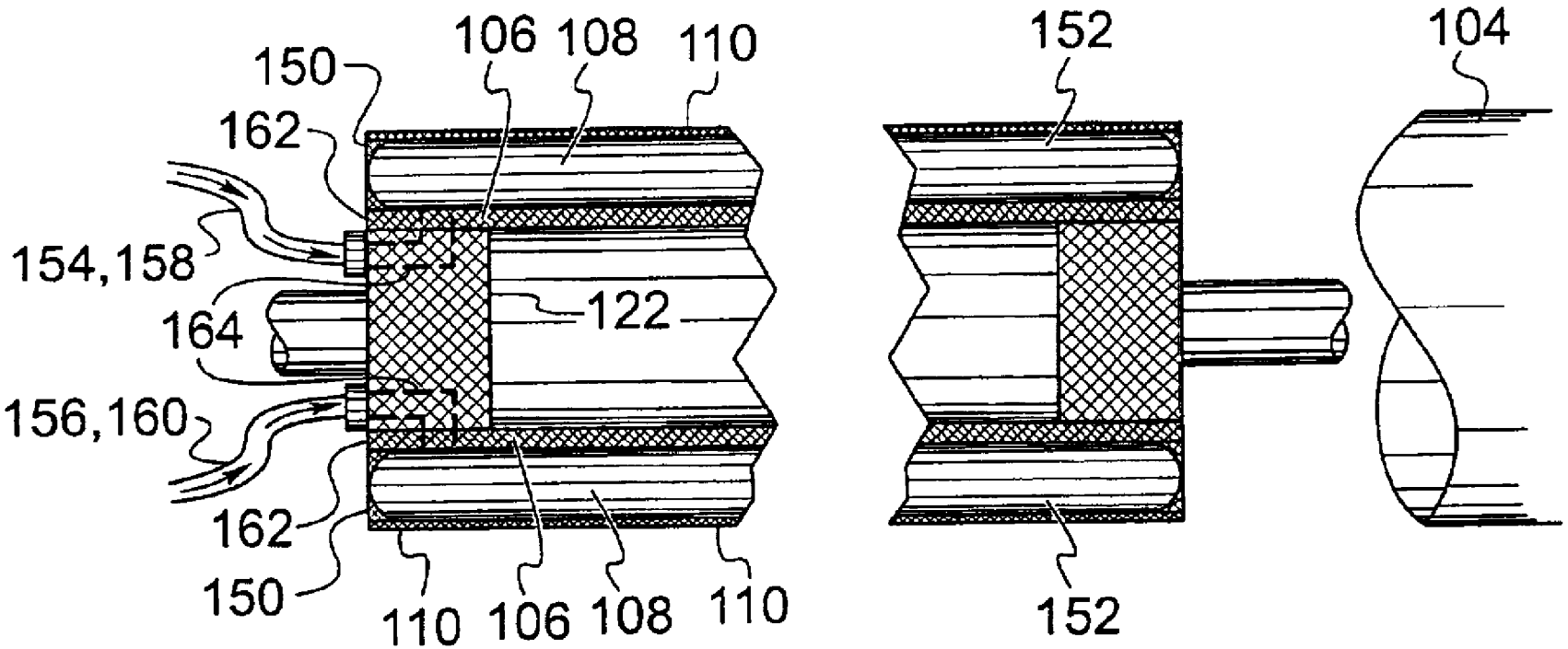
FIG. 4 is a cross-sectional view of the gapless print cylinder assembly and printing surface of FIG. 1 taken along line A—A according to another embodiment of the present invention.

Referring to FIG. 5, mechanical bonding methods may also be used with the present invention to secure the printing sleeve 104 to the outer shell 110 of the print cylinder assembly 102 in addition to, or in lieu of the methods discussed with reference to FIGS. 2–4. This may be desirable because under certain circumstances, through holes may be unavailable, inaccessible or cause printing problems. For example, a heat shrink fit technique may be used where the printing sleeve 104 is slid over the outer shell 110 and heat is used to shrink fit the printing sleeve 104 to the outer shell 110. A spline and taper lock arrangement (not shown) may be used where grooved passages are cut or molded to fit complementary matching forms. Alternatively, "V" notch/groove techniques may be used. Still further, the printing sleeve 104 and outer shell 110 can be formed to have complimentary tapering such that the printing sleeve 104 can be taper fit onto the outer shell 110. The surface of the print cylinder assembly 102 may further be knurled. Additionally, friction materials with high coefficients of friction such as polyurethanes and nitriles may be used.

Where it is undesirable, or impractical to use a compressed source to float the printing sleeve 104 on to, and off of the print cylinder assembly 102, an optional bonding device 148 may be applied between the print cylinder assembly 102, and the printing sleeve 104. The inside diameter of the printing sleeve 104 need not be nominally smaller than the outside diameter of the print cylinder assembly 102 when using the bonding device 148. Rather, the printing sleeve 104 should be dimensioned to allow the printing sleeve 104 to slide over the print cylinder assembly 102.

The bonding device 148 may be for example, Velcro® brand hook and loop fastener or other types of fastening fabric. The bonding device 148 may also be implemented using a heat activated thermoplastic or thermoset bonding agent, such as polyvinyls, acrylics, polyurethanes, polyolefins, and thermoplastic esters. The bonding device 148 may be applied using any techniques including for example ring coating or using a cross-head extruder. Upon or during assembly of the printing sleeve 104 to the print cylinder assembly 102, heat is applied to activate the adhesive character of the bonding device 148.

After removal of the heat, cooling completes the bonding process. The bonding device 148 can be applied as an extruded tube, spiral wrapped tape, or directly coated. For example, bonding can be achieved by first applying heat to a predetermined level to melt the bonding device 148. The bonding device 148 will become a fluid when melted, allowing the printing sleeve 104 to be slid onto the print cylinder assembly 102. Then, by applying a higher heat, the bonding device 148 cures and sets. The printing sleeve 104 can be removed from the print cylinder assembly 102 by applying a removal force, for example by heating the gapless printing system 100 and removing the printing sleeve 104 before the temperature cools sufficiently to reactivate the bonding properties of the bonding device 148. When utilizing a heat activated adhesive to bond the printing sleeve 104 to the print cylinder assembly 102, it may be necessary to recondition the outer surface of the print cylinder assembly 102 prior to installation of the new printing sleeve 104.

As an alternative to the heat activated adhesive, the bonding device 148 may be a solvent activated bonding adhesive agent or catalytic such as cot adhesive applied between the printing sleeve 104 and the print cylinder assembly 102. The bond is activated when the solvent is completely evaporated. To remove the printing sleeve 104 from the print cylinder assembly 102, a removing force is applied. For example, the printing sleeve 104 is mechanically cut off, using care not to damage the print cylinder assembly 102. As with the use of the heat-activated adhesive, some reconditioning of the print cylinder assembly 102 may be required prior to installing the new printing sleeve 104. It shall be appreciated that other chemical adhesive systems can be utilized to secure the printing sleeve 104 to the print cylinder assembly 102.

Figure 6:
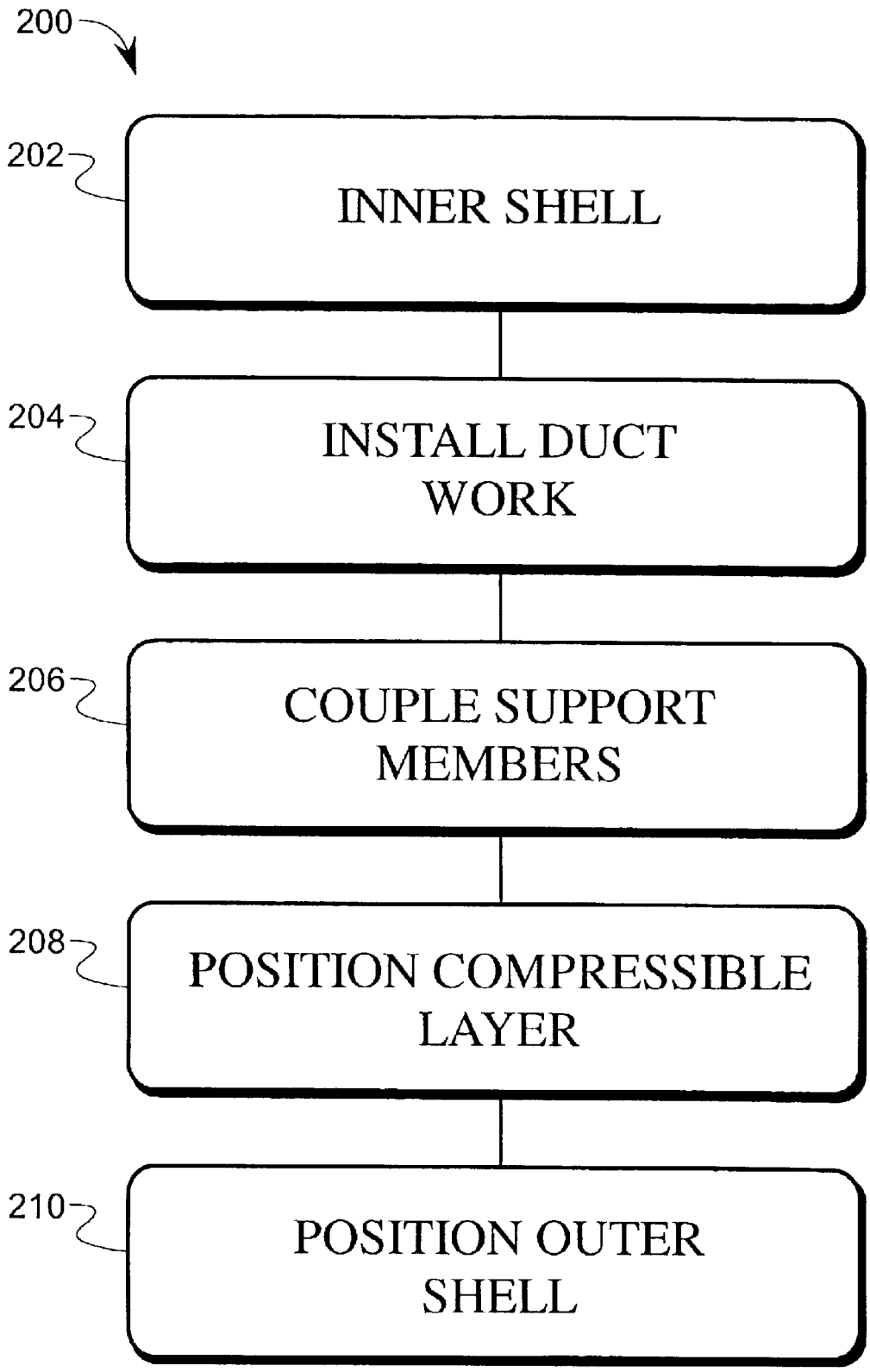
FIG. 6 is a flow chart illustrating a method of constructing a print cylinder assembly according to one embodiment of the present invention.

Referring to FIG. 6, a method 200 of manufacturing a print cylinder assembly is flow-charted. An inner shell is obtained at step 202. Duct work necessary to float a printing face over the print cylinder assembly is optionally installed in the inner shell at step 204. A support carrier is then coupled to the inner shell about each of the first and second end portions at step 206. The support carrier is adapted to support the gapless print cylinder assembly when mounted on a press. For example, the support carrier may include first and second plugs that define spaced end journal and bearing members as described more fully herein. A compressible layer, which may include for example, a layer of compressible material or a chamber or bladder adapted to receive and discharge fluid e.g. pneumatic or hydraulic, is positioned about the inner shell at step 208, and an outer shell is positioned over and generally coaxial with the inner shell and compressible layer at step 210. The steps embodying the method 200 may be performed in any order. For example, it may be desirable to position the compressible layer and outer shell over the inner shell prior to coupling the support carriers.

Having described the invention in detail and by reference to preferred embodiments thereof, it will be apparent that modifications and variations are possible without departing from the scope of the invention defined in the appended claims.

What is claimed is:

1. A print cylinder assembly comprising:

a cylinder assembly comprising:

an inner shell having a first end portion, a second end portion, and a body portion;

a support carrier coupled to said inner shell about each of said first and second end portions, said support carrier adapted to support said cylinder assembly when said cylinder assembly is mounted on a printing press;

an outer shell positioned over and generally coaxial with said inner shell;

a compressible layer located between said inner shell and said outer shell;

at least one reinforcing layer disposed between said inner and outer shells;

and a printing sleeve that is removably attachable to said cylinder assembly over said outer shell such that when said printing sleeve is mounted on said cylinder assembly, lateral and rotational motion of said printing sleeve with respect to said cylinder assembly is prevented.

2. The print cylinder assembly according to claim 1, wherein said support carrier comprises a first plug at said first end portion and a second plug at said second end portion of said inner shell.

3. The print cylinder assembly according to claim 1, wherein said inner shell comprises a carbon fiber shell.

4. The print cylinder assembly according to claim 1, wherein said outer shell comprises a carbon fiber shell.

5. The print cylinder assembly according to claim 1, wherein said outer shell of said cylinder assembly is adapted to deflect when operating in the nip of offset transfer points in an offset printing operation.

6. The print cylinder assembly according to claim 1, wherein said inner shell is substantially hollow.

7. The print cylinder assembly according to claim 1, wherein said compressible layer, comprises a layer of compressible material.

8. The print cylinder assembly according to claim 1, wherein said compressible layer comprises a chamber between said inner and outer shells, said chamber fillable with a fluid source.

9. The print cylinder assembly according to claim 8, further comprising an inflatable member positioned within said chamber arranged to receive and bleed said fluid source.

10. A print cylinder assembly comprising:

a cylinder assembly comprising:

an inner shell having a first end portion, a second end portion, and a body portion;

a support carrier coupled to said inner shell about each of said first and second end portions, said support carrier adapted to support said cylinder assembly when said cylinder assembly is mounted on a printing press;

an outer shell having an outside diameter positioned over and generally coaxial with said inner shell;

a compressible layer located between said inner shell and said outer shell;

and a printing sleeve having an inside diameter normally less than said outside diameter of said outer shell that is removably attachable to said cylinder assembly over said outer shell by diametrically expanding said inside diameter of said printing sleeve to fit over said outer shell such that said printing sleeve is secured to said cylinder assembly by fictional forces such that when said printing sleeve is mounted on said cylinder assembly, lateral and rotational motion of said printing sleeve with respect to said cylinder assembly is prevented.

11. The print cylinder assembly according to claim 10, wherein said cylinder assembly further comprises plurality of apertures extending through said outer shell, said apertures arranged to allow the passage of gas under pressure to expand said inner diameter of said printing sleeve sufficient to allow said printing sleeve to slide over said cylinder assembly.

12. The print cylinder assembly according to claim 11, further comprising a compression/expansion valve coupled to said apertures, said expansion/compression valve arranged to selectively accept a pressurized gas and force said pressurized gas.

13. A print cylinder assembly comprising:

a cylinder assembly comprising:

an inner shell having a first end portion, a second end portion; and a body portion;

a support carrier coupled to said inner shell about each of said first and second end portions, said support carrier adapted to support said cylinder assembly when said cylinder assembly is mounted on a printing press;

an outer shell positioned over and generally coaxial with said inner shell; and a compressible layer located between said inner shell and said outer shell, wherein a printing sleeve is removably attachable to said cylinder assembly over said outer shell by releasably mechanically bonding said printing sleeve to said outer shell of said cylinder assembly such that when said printing sleeve is mounted on said cylinder assembly, lateral and rotational motion of said printing sleeve with respect to said cylinder assembly is prevented.

14. The print cylinder assembly according to claim 13, wherein said printing sleeve is releasably mechanically bonded to said outer shell of said cylinder assembly using a hook and loop fastener.

15. The print cylinder assembly according to claim 13, wherein said printing sleeve is releasably securable to said cylinder assembly by a heat activated bonding adhesive.

16. A print cylinder assembly comprising:

a cylinder assembly comprising:

an inner shell having a first end portion, a second end portion, and a body portion;

a support carrier coupled to said inner shell about each of said first and second end portions, said support carrier adapted to support said cylinder assembly when said cylinder assembly is mounted on a printing press;

an outer shell positioned over and generally coaxial with said inner shell; and a compressible layer located between said inner shell and said outer shell, wherein a printing sleeve is removably attachable to said cylinder assembly over said outer shell by releasably securing said printing sleeve to said outer shell of said cylinder assembly by a solvent activated bonding agent such that when said printing sleeve is mounted on said cylinder assembly, lateral and rotational motion of said printing sleeve with respect to said cylinder assembly is prevented.

17. A print cylinder assembly comprising:

a cylinder assembly comprising:

an inner shell having a first end portion, a second end portion, and a body portion;

a support carrier coupled to said inner shell about each of said first and second end portions, said support carrier adapted to support said cylinder assembly when said cylinder assembly is mounted on a printing press;

a compressible layer around said inner shell; and an outer shell defined by a first durable layer comprising a thin film over said compressible layer, wherein a printing sleeve is removably attachable to said cylinder assembly over said outer shell such that when said printing sleeve is mounted on said cylinder assembly, lateral and rotational motion of said printing sleeve with respect to said cylinder assembly is prevented.

18. The print cylinder assembly according to claim 17, wherein said inner shell comprises steel.

19. The print cylinder assembly according to claim 17, wherein said compressible layer comprises a select one of an elastomeric layer, a polymeric layer and a chamber inflatable using a fluid source.

20. The print cylinder assembly according to claim 17, wherein said support carrier comprises a first plug at said first end portion and a second plug at said second end portion of said inner shell.

21. The cylinder assembly according to claim 17, wherein said outer shell of said cylinder assembly is adapted to deflect when operating in the nip of offset transfer points in an offset printing operation.

22. The print cylinder assembly according to claim 17, wherein said inner shell is substantially hollow.

23. The print cylinder assembly according to claim 17, wherein said first durable layer of said cylinder assembly has an outside diameter and said printing sleeve has an inside diameter normally less than said outside diameter of said first durable layer, wherein said printing sleeve is removably securable to said cylinder assembly by diametrically expanding said inside diameter of said printing sleeve to fit over said first durable layer of said cylinder assembly such that said printing sleeve is secured to said cylinder assembly by frictional forces.

24. The print cylinder asaemhly according to claim 23, wherein said cylinder assembly further comprises a plurality of apertures extending through said first durable layer, said apertures arranged to allow the passage of gas under pressure through said apertures to expand said inner diameter of said printing sleeve sufficient to allow said printing sleeve to slide over said cylinder assembly.

25. The print cylinder assemblyn according to claim 24, further comprising a compression/expansion valve coupled to said apertures, said expansion/contraction valve arranged to selectively accept a pressurized gas and force said pressurized gas.

26. The print cylinder assembly according to claim 17, wherein said cylinder assembly further comprises at least one reinforcing layer disposed between said inner shell and said first durable layer.

27. The print cylinder assembly according to claim 17, wherein said printing sleeve is releasably mechanically bonded to said first durable layer of said cylinder assembly.

28. The print cylinder assembly according to claim 22, wherein said printing sleeve is releasably mechanically bonded to said first durable layer of said cylinder assembly using a hook and loop fastener.

29. The print cylinder assembly according to claim 17, wherein said printing sleeve is releasably securable to said cylinder assembly by a heat activated bonding adhesive.

30. The print cylinder assembly according to claim 17, wherein said printing sleeve is releasably securable to said cylinder assembly by a bonding agent activated by a select one of heat and solvent.

31. A gapless printing system comprising:

a cylinder assembly comprising:

a hollow carbon fiber inner shell having a first end portion, a second end portion, and a generally cylindrical body portion;

a support carrier coupled to said inner shell about each of said first and second end portions, said support carrier adapted to support said cylinder assembly when said cylinder assembly is mounted on a printing press;

a carbon fiber outer shell positioned over and generally coaxial with said inner shell, said carbon fiber outer shell adapted to allow said outer shell to deflect when operating in the nip of offset transfer points in an offset printing operation;

a plurality of apertures extending through said outer shell; a compressible layer located between said inner shell and said outer shell, wherein said compressible layer comprises a select one of an elastomeric layer, a polymeric layer and a chamber inflatable using a fluid source; and a printing sleeve removably attachable to said cylinder assembly over said outer shell such that when said printing sleeve is mounted on said cylinder assembly, lateral and rotational motion of said printing sleeve with respect to said cylinder assembly is prevented, said apertures arranged to allow a pressurized gas through said apertures to expand said inner diameter of said printing sleeve sufficiently to allow said printing sleeve to slide over said cylinder assembly.

32. A method of fabricating a print cylinder assembly comprising:

forming an inner shell having a first end portion, a second end portion, and a body portion;

coupling a support carrier to said inner shell about each of said first and second end portions, said support carrier adapted to support said cylinder assembly when said cylinder assembly is mounted on a printing press;

positioning a compressible layer over said inner shell and positioning at least one reinforcing layer between said inner and outer shells; and positioning an outer shell over and generally coaxial with said inner shell and said compressible layer, and;

mounting a printing sleeve that is removably attachable to said cylinder assembly over said outer shell such that lateral and rotational motion of said printing sleeve with respect to said cylinder assembly is prevented.

33. The method of claim 32, wherein said support carrier is coupled to said inner shell by installing a first plug at said first end portion and a second plug at said second end portion of said inner shell.

34. The method of claim 32, wherein said inner shell is formed using a carbon fiber reinforced polymer resin.

35. The method of claim 32, wherein said outer shell is fabricated by forming a thin carbon fiber reinforced polymer resin.

36. The method of claim 32, wherein said outer shell of said cylinder assembly is adapted to deflect when operating in the nip of offset transfer points in an offset printing operation.

37. The method of claim 32, wherein said outer shell of said cylinder assembly is fabricated tohave an outside diameter that is normally greater than an inside diameter of said printing sleeve, wherein said printing sleeve is removably securable to said cylinder assembly by diametrically expanding said inside diameter of said printing sleeve to fit over said outer shell, such that said printing sleeve is secured to said cylinder assembly by frictional forces.

38. The method of claim 37, wherein said cylinder assembly is further fabricated by forming a plurality of apertures extending through said outer shell, said apertures arranged to allow the passage of gas under pressure to expand said inner diameter of said printing sleeve sufficient to allow said printing sleeve to slide over said cylinder assembly.

39. The method of claim 38, further comprising coupling a compression/expansion valve to said apertures, said expansion/contraction valve selectively accept a pressurized gas and force said pressurized gas.

40. The method of claim 32, wherein said printing sleeve is releasably mechanically bonded to said outer shell of said cylinder assembly.

41. The method of claim 32, wherein said printing sleeve is releasably securable to said cylinder assembly by a heat activated bonding adhesive.

42. The method of claim 32, wherein said printing sleeve is releasably securable to said cylinder assembly by a solvent activated bonding agent.

43. The method of claim 32, wherein the act of positioning said compressible layer comprises positioning a select one of an elastomeric layer, a polymeric layer and a chamber inflatable using a fluid source.

* * * * *